United States Patent [19]

Dege et al.

[11] Patent Number: 4,889,372

[45] Date of Patent: Dec. 26, 1989

[54] SWING LIMIT APPARATUS FOR CARGO BOX DOORS

[75] Inventors: Howard C. Dege; Paul R. Gilmore, both of Seaford, Del.

[73] Assignee: E. I. Du Pont de Nemours and Company, Wilmington, Del.

[21] Appl. No.: 193,844

[22] Filed: May 13, 1988

[51] Int. Cl.[4] ..... E05C 7/08

[52] U.S. Cl. ..... 292/218; 292/264; 292/DIG. 32; 24/299; 24/116 R; 298/23 R; 59/93

[58] Field of Search ..... 292/294, DIG. 21, DIG. 16, 292/DIG. 32, 264, 218, 288, 289, 339, 259 R, 329, 330; 70/93; 24/298, 299, 116; 298/23 R, 23 F, 23 D, 23 DF; 59/93; 16/82, 85, 86 C, 61, 63, 67; 105/292, 302, 308, 311.1, 388, 285

[56] References Cited

U.S. PATENT DOCUMENTS

| | | | |
|---|---|---|---|
| 339,883 | 4/1886 | Hawes | 292/264 |
| 474,744 | 5/1892 | Johnson | 105/306 |
| 807,779 | 12/1905 | Rinald | 292/264 |
| 890,518 | 6/1908 | Kleidmann | 292/264 |
| 1,395,028 | 10/1921 | Berg et al. | 298/23 A |
| 1,420,315 | 6/1922 | Herbst et al. | 298/23 R |
| 1,575,429 | 3/1926 | Lawrence | 292/264 |
| 1,662,653 | 3/1928 | Young et al. | 298/38 |
| 1,759,677 | 5/1930 | Wine | 298/23 R |
| 2,682,233 | 6/1954 | Ingram | 105/311.1 |
| 2,816,431 | 12/1957 | Harney | 70/93 |
| 2,881,611 | 4/1959 | Callegari | 292/264 |
| 2,908,529 | 10/1959 | Davidson | 298/23 R |
| 3,011,818 | 12/1961 | Matthiessen | 292/288 |
| 3,059,952 | 10/1962 | Wittman et al. | 292/288 |
| 3,081,616 | 3/1963 | Mintz | 70/93 |
| 3,125,875 | 3/1964 | Friedman | 70/93 |
| 3,174,787 | 3/1965 | Kolman | 24/115 R |
| 3,544,154 | 12/1970 | Ford | 292/264 |
| 3,894,762 | 7/1975 | Segal | 292/264 |
| 4,186,958 | 2/1980 | Welch | 292/264 |
| 4,564,230 | 1/1986 | Haist | 292/264 |

FOREIGN PATENT DOCUMENTS

| | | | |
|---|---|---|---|
| 386194 | 12/1922 | Fed. Rep. of Germany | 292/264 |
| 17447 | of 1890 | United Kingdom | 292/264 |
| 1155157 | 6/1969 | United Kingdom | 292/264 |

OTHER PUBLICATIONS

*Popular Science* Publication, Oct. 1962, p. 168.

*Primary Examiner*—Gary L. Smith
*Assistant Examiner*—Eric K. Nicholson

[57] ABSTRACT

A cargo box door swing limit apparatus includes a flexible elongate member and attachment points at intervals along the member so that the apparatus can be used with most of the various trailer latch arrangements.

7 Claims, 5 Drawing Sheets

SWING LIMIT APPARATUS FOR CARGO BOX DOORS

FIELD OF THE INVENTION

This invention relates to safety devices for freight vehicles and more particularly concerns apparatus to limit the swing of a cargo box door upon opening to safely check for loaded items leaning against the door before fully opening the door.

BACKGROUND OF THE INVENTION

Cargo boxes typically used on tractor trailers are provided with a pair of hinged rear doors which swing outwardly to provide access to the cargo box. When the doors are swung fully open the access opening is virtually equal to the box cross-section. After the cargo has been loaded the doors are swung to the closed position and each is latched shut by imparting rotation to a vertical latch bar by means of a handle to cause upper and lower latch jaws to lock in receptacles fixed in the door frame. After the doors are closed, no opening exists whereby the state of the cargo may be inspected. After a highway trip, it is not uncommon for the cargo to shift and the contents of the box may come loose and slide or roll against one or both doors. When the latches holding a door closed are released, the door may be forcibly driven outwardly by the items pressing against it. The forceful action of the door and any items falling from the trailer as the door opens poses a great risk of serious injury to persons in the vicinity of the trailer doors.

While devices are known for restraining the opening of a cargo box door, some of these are mechanically complicated and require modification or retrofitting of the latch mechanism and, in general, are limited to use on the trailer to which the devices have been fitted. Other devices of more simple design are known but these also cannot be used interchangeably for many types of trailers.

SUMMARY OF THE INVENTION

Apparatus for limiting the swing of a cargo box door upon opening is provided. The apparatus is for use with a cargo box having an opening and a pair of doors pivotally attached to the cargo box to open by swinging outwardly from the cargo box and meeting centrally of the opening when the doors are closed. Each of the doors have a latch mechanism for securing the doors when closed including a handle connected to a rotatable latch-actuating bar in which the handle is moved to a position adjacent the door to engage the latch mechanism to secure the door in a closed position. A handle keeper secures the handle adjacent to the door. The handle keeper has a lower bracket fixedly attached to the door and an upper, pivotally attached bracket.

In accordance with the invention, the apparatus comprises a flexible elongate member and attachment means for attaching the elongate member to the lower keeper bracket of each door with at least a portion of the flexible elongate member extending between the doors when closed. The attachment means includes at least first, second, and third attachment points spaced apart along the flexible member so that the apparatus is attachable to lower keeper brackets of cargo boxes with different spacings to limit the swing of one of the doors upon opening.

In accordance with a preferred form of the invention, the attachment means further comprises a fourth spaced-apart attachment point. Most preferably, the distance between the first and second attachment points, when the flexible member is fully extended between the points, is between about 27 inches and about 31 inches. The distance between the first and third attachment points, when the flexible member is fully extended between the points is between about 35 inches and about 39 inches. The distance between the first and fourth attachment points, when the flexible member is fully extended, is between about 46 inches and about 50 inches. In a preferred form of the invention, the flexible elongate member is advantageously provided by a length of chain. The attachment means are advantageously provided by hooks and the lower keeper brackets on the cargo box doors have bores for receiving the hooks. Most preferably, the hooks have a spring-operated safety gate to prevent the hooks from being dislodged from the bores of the lower brackets in use.

BRIEF DESCRIPTION OF THE DRAWINGS

The invention may be understood by reference to the following detailed description of a preferred embodiment of the invention which follows, reference being made to the accompanying drawings in which.

DETAILED DESCRIPTION

Figure 1:
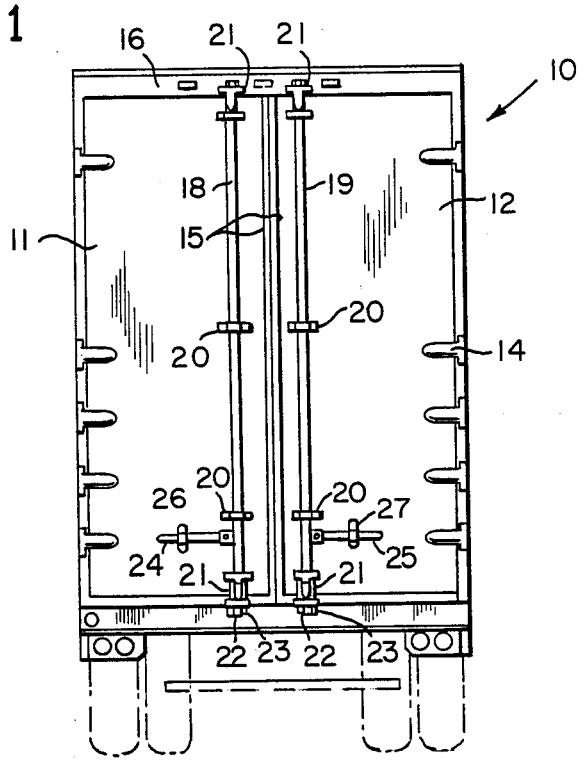
FIG. 1 is a rear elevational view of a cargo box having one type of arrangement of door locking latches.

Referring now to the drawings in which like reference characters designate like or corresponding parts throughout the several views, a cargo box 10 shown in FIG. 1 is of conventional design and is provided with left and right rear doors 11 and 12, respectively, which are pivotally mounted on vertical hinges 14 on the door frame 16 so that the doors meet along their inner vertical edges 15. The right door 12 overlaps the left door 11 (not shown) at the meeting of the vertical edges and thus it is generally necessary to open the right door 12 before the left door 11. The doors 11 and 12 extend slightly below the box floor level (not shown) and engage the outer margins of the box frame 16. Each door is provided with a latch-actuating bar, left and right bars respectively designated 18 and 19. Bars 18 and 19 are rotatable in sets of vertically-spaced journals 20 intermediate their vertical extent and are further journalled in upper and lower door-mounted bearings 21.

Figure 4:
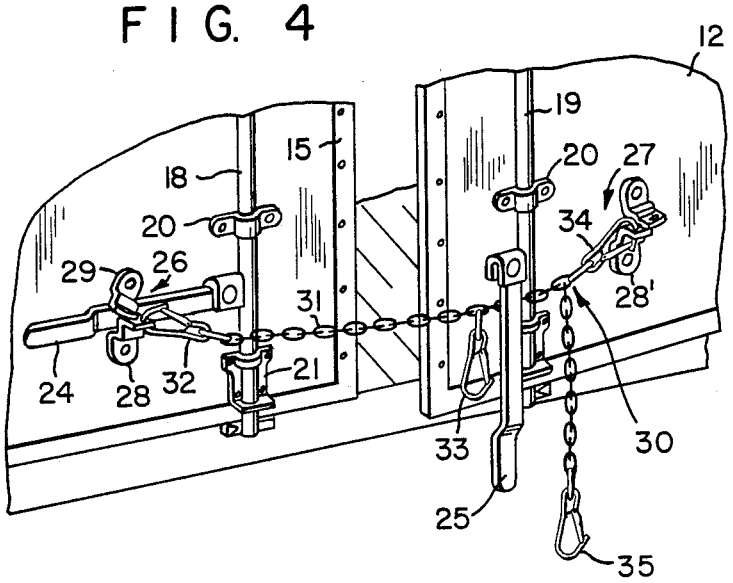
FIG. 4 is a perspective view of a lower rear portion of cargo box as shown in FIG. 3.
Figure 2:
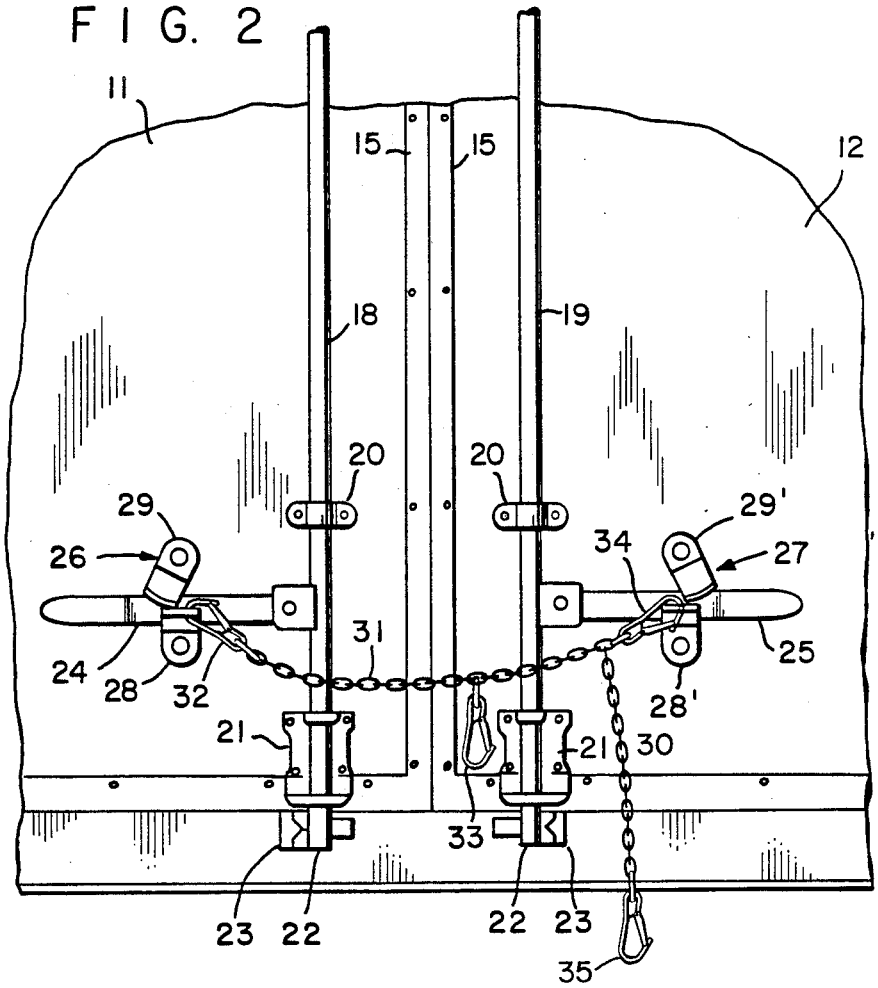
FIG. 2 is an enlarged view of a portion of FIG. 1 showing the lower ends of door latches of FIG. 1, and the preferred door swing limit apparatus in accordance with the invention as used with this type of latch arrangement.
Figure 7:
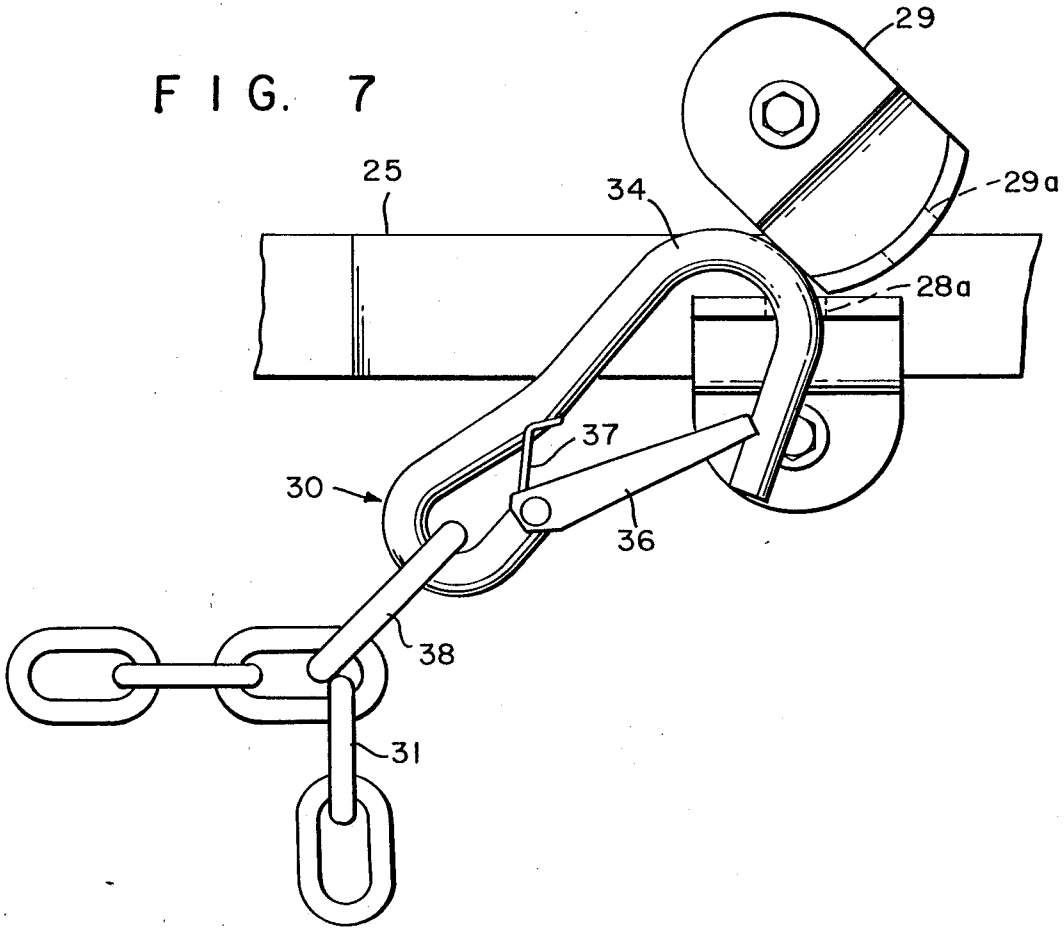
FIG. 7 is an enlarged view of a portion of FIG. 2.

The extremities of each latch-actuating bar are conventionally fitted with a claw-like latch or jaw structure 22 that engages frame-mounted receptacles 23, the engagement being made by imparting rotation to the latch-actuating bar by means of respective left and right vertically-pivoting handles 24 and 25 when these are brought closely adjacent the doors 11 and 12. Left and right handle keepers 26 and 27 are provided to maintain the handles 24 and 25 adjacent to the doors and in a generally horizontal position in transit. As shown in FIGS. 2, 4 and 7, each of the handle keepers includes a lower keeper bracket 28 (left) and 28' (right) which is fixedly mounted on the door and provides a receptacle for receiving the handle positioned adjacent the door. An upper keeper bracket 29 (left) and 29' (right) is pivotally mounted on the door above the lower bracket 28 and closes the receptacle from above to prevent the handle from being dislodged from the receptacle and pivots to open the receptacle. As is shown in dotted lines in FIG. 7, the upper and lower brackets are provided with bores 28*a* and 29*a*, respectively, which are vertically aligned when the upper bracket is in position to close the handle receptacle. The bores 28*a* and 29*a* are provided for the purpose of receiving the shackle of a padlock or applying a seal to secure the keeper and thereby lock the latch mechanism for the door.

To open the doors, the upper brackets 29 and 29' of the keepers that maintain the handles contiguous to their respective doors are released by pivoting the upper bracket to be clear of the lower bracket and each arm is lifted upwardly a short distance to remove it from the receptacle and is swung outwardly through an angle usually less than 45°. to disengage the claw-like latch 22 from the receptacle 23.

Figure 3:
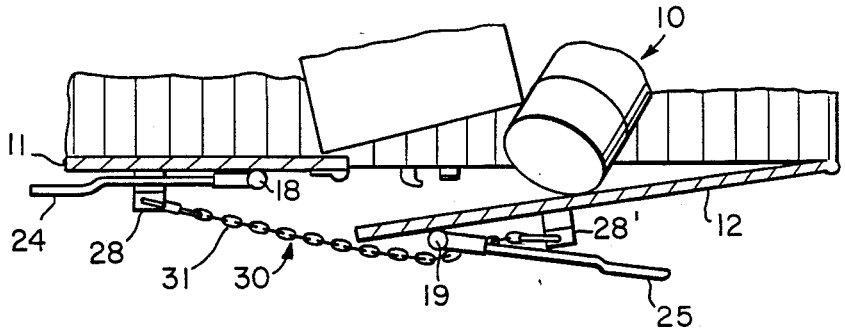
FIG. 3 is a top plan view of the cargo box of FIGS. 1 and 2 with an opened door limited from swinging fully open while a hazardous cargo condition exists.

Referring now to FIGS. 2, 3, and 4, a door swing limit apparatus 30 in accordance with the invention comprises a flexible elongate member and means for attaching the member to the doors of cargo boxes fitted with latch mechanisms of the type as described above before the doors are opened. In the preferred apparatus, the elongate member is a length of chain 31 provided with attachment means for attaching the chain 31 to the lower keeper bracket 28 on the left door 11 with the chain 31 extending between the doors to the lower keeper bracket 28' on the right door 12.

The apparatus 30 includes at least three attachment points spaced apart along the chain 31 so that cargo boxes having different spacings between the lower keeper brackets can be accommodated. In the embodiment illustrated, there are four such attachment points. Attachment points are preferably provided successively along the chain by first, second, third, and fourth hooks which are identified by the numerals 32–35, respectively. The hooks 32–35 are dimensioned to be received in the lower keeper bracket bores 28*a* of each door. As most clearly shown in FIG. 7, each of the hooks are preferably equipped with safety gates 36 which, by action of spring 37, form a closed loop following engagement with a lower bracket to prevent the accidental disengagement of the hook from the bores.

Figure 5:
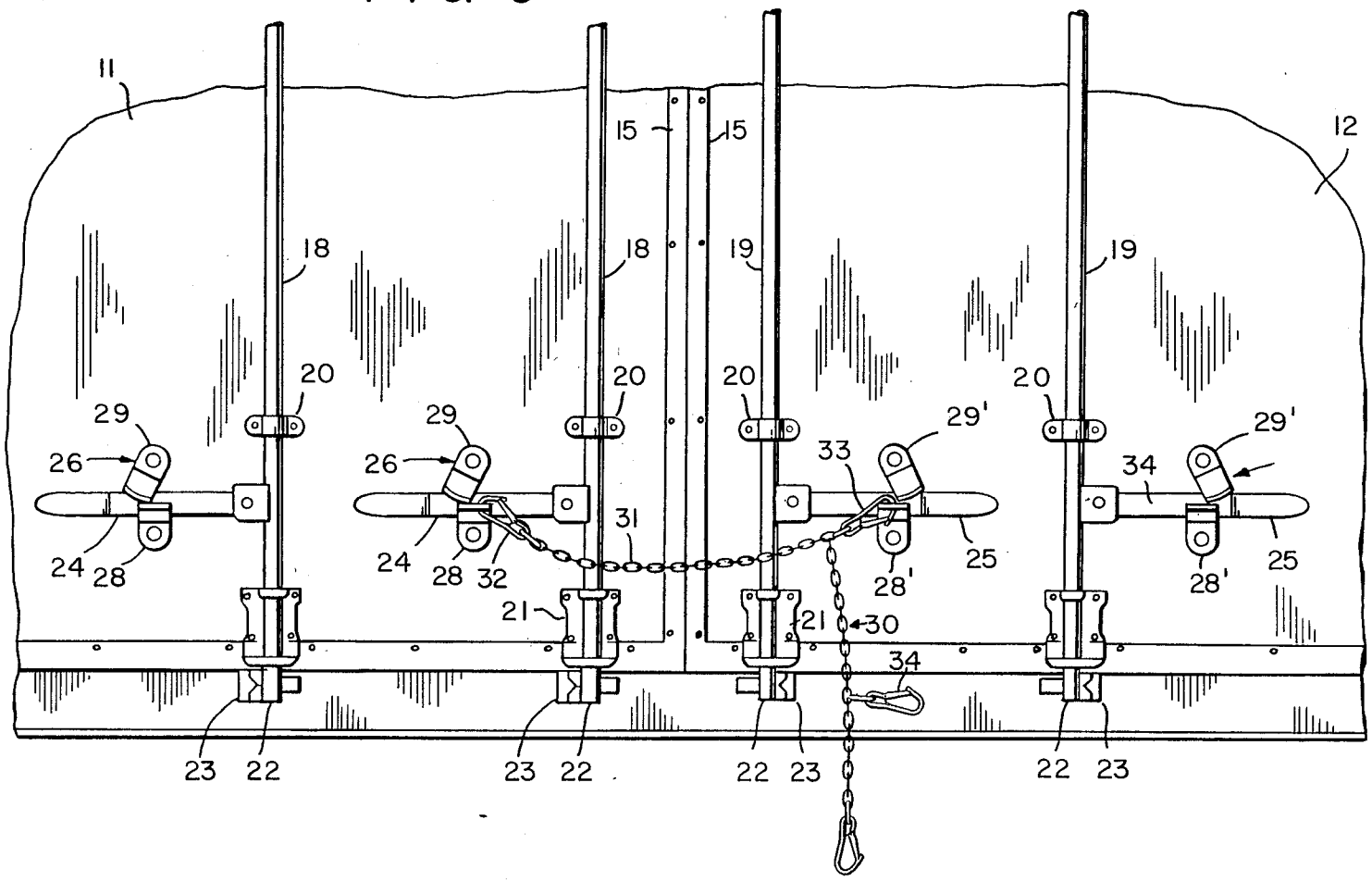
FIG. 5 is a rear elevational view of a cargo box having another type of arrangement of door locking latches showing the preferred door swing limiting apparatus according to the present invention as used.
Figure 6:
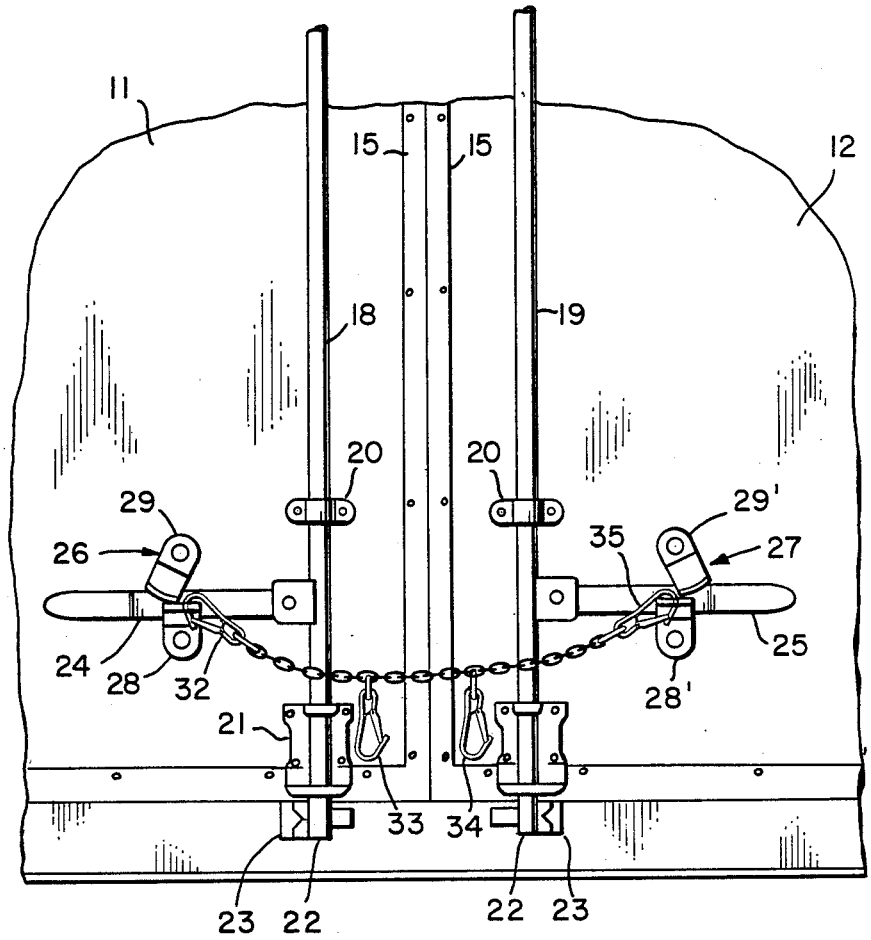
FIG. 6 is a rear elevational view of a cargo box having yet another arrangement of door locking latches showing the preferred door swing limiting apparatus according to the present invention as used.

Referring now to FIGS. 2, 5, and 6, depicting the preferred embodiment, it will be understood that the hooks are spaced apart along the chain 31 at selected intervals to accommodate trucks with different arrangements of latch mechanisms and enable the door to swing open only a short distance, e.g., 1014 12 inches. Since the hooks themselves add to the length of the chain, the hooks are connected to the chain so that the attachment points of the hooks, i.e., where the hooks engage the bores in the keeper brackets, are preferably at specified distances. In the preferred embodiment, the distance between the first and second attachment points, when the flexible member is fully extended and including the length provided by the first and second hooks, is between about 27 inches and about 31 inches. The distance between the first and third attachment points, when the flexible member is fully extended and including the first and third hooks is between about 35 inches and about 39 inches. The distance between the first and fourth attachment points, when the flexible member is fully extended and including the first and fourth hooks, is between about 46 inches and about 50 inches.

In FIG. 2, a trailer having one type of single latch arrangement is illustrated. On such trailers, the distance between the lower keeper bracket 28 on the left door 11 and the lower keeper bracket 28' on the right door 12 is such that the first hook 32 and the third hook 34 are employed. FIG. 5 illustrates a double latch arrangement used for some trailers. For some double latch trailers, the distance between the latch bores of respective doors is such that the first hook 32 and the second hook 33 are employed. FIG. 6 illustrates yet another single latch arrangement in which the distance between lower keeper brackets is greater than the trailer in FIG. 2. For such trailers, the first and fourth hooks 32 and 35 are employed.

The door swing limit apparatus 30 is suitably fabricated from chain such as ¼ inch cadmium plated proof coil chain with a working load rating of 1,250 pounds. Suitable hooks are ⅜ inch diameter multi-purpose hooks with safety gates having an overall dimension of, for example, about 4 inches. The length of chain between the first hook 32 and the second hook 33 is such that distance of between about 27 inches and about 31 inches is provided at the attachment point of the hooks. Similarly, the distance between the first and third hooks 32 and 34 along the chain is such that attachment points are between about 35 and 39 inches apart and the distance between the attachment points on the first and fourth hooks 32 and 35 is between about 46 and about 50 inches. Each hook is suitably attached to the chain by an attachment link 38 which is closed such as by welding.

With reference to FIGS. 2, 3 and 4, the use of the invention is illustrated. Depending on the type of trailer, the appropriate hooks are connected to the lower keeper brackets 28 for each of the doors by inserting the hooks into the bores 28*a* after pivoting the upper bracket out of the way. First hook 32 is generally used in combination with the second hook 33, third hook 34 or fourth hook 35 as is needed to provide some slack so that a door can be opened for inspection e.g., 10–12 inches. Choice of the proper hook combination is made by the user based on past use of the apparatus with a particular latch arrangement or is done empirically with an unfamiliar type of trailer. After attachment, the latch on the right door 12 is then released by removing the handle 25 from the lower keeper bracket 28 and is rotated to disengage the claw-like latch 22 from its receptacle 23 on the door frame 16. The right door 12 is then allowed to open to the limited extent permitted by the slack in the chain extending between the two doors. It will be understood that the right door 12 is opened first for the cargo box 10 illustrated since the right door 12 overlaps the left door 11 but that the left door 11 may be opened first in other types of trailers.

As shown in FIG. 3, when the contents of the cargo box are leaning against the door 12 and urging it outwardly, the door swing limit apparatus 30 prevents the door from opening and thus prevents the contents of the cargo box 10 from falling out and causing injury to those standing near the door. As shown in FIG. 4, the door is restrained with an opening of approximately 10–12 inches so that it is possible to view inside the cargo box and safely determine whether a hazard exists.

The door swing limit apparatus in accordance with the present invention makes it possible to safely inspect the contents while opening trailer doors. Due to the selected intervals between the hooks, the preferred apparatus in accordance with the invention permit use of the apparatus on most currently manufactured trailers with horizontally hinged rear doors with single or double latches. The apparatus is simple to use and does not require any retrofitting or modification of existing trailer latches.

Although a particular embodiment of the present invention has been described in the foregoing detailed description, it will be understood that the invention is capable of numerous modifications and substitution of parts without departing from the spirit of the invention as set forth in the appended claims.

We claim:

1. In combination with a cargo box having an opening and a pair of doors for closing said opening, said doors being pivotally attached to said cargo box to open by swinging outwardly from said cargo box and meeting centrally of said opening when said doors are closed, said doors each having a latch mechanism for securing said doors when closed including a handle connected to a rotatable latch-actuating bar in which the handle is moved to a position adjacent said door to engage said latch mechanism to secure said door, said mechanism having a handle keeper including a lower bracket fixedly attached to said door and an upper bracket pivotally attached to said door, said brackets together operating to selectively maintain said handle adjacent to said door, apparatus for limiting the swing of a one of said doors upon opening comprising:

a flexible elongate member;

attachment means connected to said flexible elongate member for attaching to said lower keeper bracket of each door with at least a portion of said flexible member extending between said doors when closed, said attachment means providing at least first, second, and third attachment points spaced-apart along said flexible member and each of said attachment points being capable of attachment to either of said lower keeper brackets so that said apparatus is attachable to lower keeper brackets of cargo boxes with different spacings to limit the swing of one of said doors upon opening, wherein said each of said lower keeper brackets includes a bore therethrough and said attachment means comprises hooks attached to said flexible member for being received in said bores in said lower keeper brackets.

2. In combination with a cargo box having an opening and a pair of doors for closing said opening, said doors being pivotally attached to said cargo box to open by swinging outwardly from said cargo box and meeting centrally of said opening when said doors are closed, said doors each having a latch mechanism for securing said doors when closed including a handle connected to a rotatable latch-actuating bar in which the handle is moved to a position adjacent said door to engage said latch mechanism to secured said door, said mechanism having a handle keeper including a lower bracket fixedly attached to said door and an upper bracket pivotally attached to said door, said brackets together operating to selectively maintain said handle adjacent to said door, apparatus for limiting the swing of a one of said doors upon opening comprising:

a flexible elongate member;

attachment means connected to said flexible elongate member for attaching to said lower keeper bracket of each door with at least a portion of said flexible member extending between said doors when closed, said attachment means providing at least first, second, and third attachment points spaced-apart along said flexible member and each of said attachment points being capable of attachment to either of said lower keeper brackets so that said apparatus is attachable to lower keeper brackets of cargo boxes with different spacings to limit the swing of one of said doors upon opening, wherein said each of said lower keeper brackets includes a bore therethrough and said attachment means comprises hooks attached to said flexible member for being received in said bores in said lower keeper brackets, and wherein said attachment means further comprises a fourth attachment point.

3. In combination with a cargo box having an opening and a pair of doors for closing said opening, said doors being pivotally attached to said cargo box to open by swinging outwardly from said cargo box and meeting centrally of said opening when said doors are closed, said doors each having a latch mechanism for securing said doors when closed including a handle connected to a rotatable latch-actuating bar in which the handle is moved to a position adjacent said door to engage said latch mechanism to secure said door, said mechanism having a handle keeper including a lower bracket fixedly attached to said door and an upper bracket pivotally attached to said door, said brackets together operating to selectively maintain said handle adjacent to said door, apparatus for limiting the swing of a one of said doors upon opening comprising:

a flexible elongate member;

attachment means connected to said flexible elongate member for attaching to said lower keeper bracket of each door with at least a portion of said flexible member extending between said doors when closed, said attachment means providing at least first, second, and third attachment points spaced-apart along said flexible member and each of said attachment points being capable of attachment to either of said lower keeper brackets so that said apparatus is attachable to lower keeper brackets of cargo boxes with different spacings to limit the swing of one of said doors upon opening, wherein said each of said lower keeper brackets includes a bore therethrough and said attachment means comprises hooks attached to said flexible member for being received in said bores in said lower keeper brackets, wherein said attachment means further comprises a fourth attachment point, and wherein the distance between said first and second attachment points when said flexible member is fully extended between said points is between about 27 inches and about 31 inches, the distance between said first and third attachment points when said flexible member is fully extended between said points is between about 35 inches and about 39 inches and the distance between said first and fourth attachment points when said flexible member is fully extended is between about 46 inches and about 50 inches.

4. The apparatus of claims 1, 2 or 3 wherein said flexible elongate member is a chain.

5. The apparatus of claims 1, 2 or 3 wherein said hooks further comprise means for selectively preventing said hooks from being withdrawn from said bores.

6. The apparatus of claim 5 wherein said means for selectively preventing said hooks from being withdrawn from said bores comprises spring-actuated gate for each hook.

7. The apparatus of claim 6 wherein said flexible elongate member is a chain.

* * * * *